US009282792B2

(12) United States Patent
Mace et al.

(10) Patent No.: US 9,282,792 B2
(45) Date of Patent: Mar. 15, 2016

(54) FOLD-OVER CLASP FOR A BRACELET

(71) Applicant: Rolex S.A., Geneva (CH)

(72) Inventors: Jean-Sebastien Mace, Esserts-Saleve (FR); Ludovic Zbylut, Poisy (FR)

(73) Assignee: ROLEX SA, Geneva (CH)

( * ) Notice: Subject to any disclaimer, the term of this patent is extended or adjusted under 35 U.S.C. 154(b) by 204 days.

(21) Appl. No.: 13/850,778

(22) Filed: Mar. 26, 2013

(65) Prior Publication Data

US 2013/0255043 A1 Oct. 3, 2013

(30) Foreign Application Priority Data

Mar. 27, 2012 (EP) ..... 12002198

(51) Int. Cl.
*A44C 5/24* (2006.01)

(52) U.S. Cl.
CPC ..... *A44C 5/24* (2013.01); *Y10T 24/44325* (2015.01)

(58) Field of Classification Search
CPC ..... A44C 5/24; A44C 5/243; A44C 5/246
USPC ..... 24/265 WS, 71 J, 265 B, 68 A, 265 BC, 24/265 EC, 70 J, 69 J, 68 J; 224/164, 171, 224/174, 176, 177, 178
See application file for complete search history.

(56) References Cited

U.S. PATENT DOCUMENTS

| | | | | |
|---|---|---|---|---|
| 2,532,840 | A * | 12/1950 | Gaun | 24/71 R |
| 5,331,723 | A * | 7/1994 | Mathieu | 24/71 J |
| 5,689,859 | A * | 11/1997 | Cuche | 24/71 J |
| 5,857,243 | A * | 1/1999 | Champion | 24/71 J |
| 5,946,776 | A * | 9/1999 | Bourquin | 24/71 J |
| 6,094,782 | A * | 8/2000 | Gay et al. | 24/71 J |
| 6,401,307 | B1 * | 6/2002 | Wild | 24/71 J |
| 6,434,798 | B1 * | 8/2002 | Yamakawa et al. | 24/71 J |
| 7,124,478 | B2 * | 10/2006 | Aquillon et al. | 24/265 WS |
| 2002/0010985 | A1 * | 1/2002 | Thalheim | 24/71 J |
| 2004/0163217 | A1 * | 8/2004 | Ferrario | 24/71 J |
| 2006/0090305 | A1 | 5/2006 | Aquillon et al. | |
| 2012/0318018 | A1 * | 12/2012 | Mouche et al. | 63/3.1 |
| 2015/0121668 | A1 * | 5/2015 | Kaltenrieder | A44C 5/24 24/71 J |

FOREIGN PATENT DOCUMENTS

| | | |
|---|---|---|
| CH | 649205 A5 | 5/1985 |
| CH | 689931 A5 | 2/2000 |
| CH | 699044 B1 | 1/2010 |

(Continued)

OTHER PUBLICATIONS

European Search Report (ESR) for EP Appl No. 12002198.5, dated Aug. 9, 2012.

*Primary Examiner* — Robert J Sandy
*Assistant Examiner* — Rowland Do
(74) *Attorney, Agent, or Firm* — Westerman, Hattori, Daniels & Adrian, LLP

(57) ABSTRACT

A bracelet clasp including first and second movable leaves pivoted about a central blade, that can occupy a first closed position suitable for holding a bracelet around the wrist of its wearer and a second open position suitable for removing the bracelet from the hand of its wearer. The two movable leaves include at least one element for interaction between them which acts on the second movable leaf when the first movable leaf is actuated, in the closing and/or opening phase of the clasp.

21 Claims, 4 Drawing Sheets

(56) References Cited

FOREIGN PATENT DOCUMENTS

| | | | | | |
|---|---|---|---|---|---|
| CN | 202233410 | U | | 5/2012 | |
| EP | 0 461 675 | A2 | | 12/1991 | |
| EP | 1 654 950 | A1 | | 5/2006 | |
| EP | 1 925 227 | A1 | | 5/2008 | |
| FR | 2825244 | A1 | * | 12/2002 | ..... A44C 5/24 |
| JP | 11-266913 | A | | 10/1999 | |

* cited by examiner

I-I

II-II

II-II

FOLD-OVER CLASP FOR A BRACELET

INTRODUCTION

The present invention relates to a clasp for a bracelet watch and a bracelet and a wristwatch as such comprising such a clasp.

PRIOR ART

Several solutions exist for coupling the two strands of a wristwatch bracelet around the wrist of its wearer. The first solution is simple and consists in furnishing the ends of each strand with interaction means, in the form for example of a simple buckle and a tongue on the one hand interacting with holes on the other hand. Such a solution has the drawback that, when the interaction means are opened, the two strands of the bracelet are immediately separated and cause risk of the wristwatch falling.

In order to alleviate this drawback, another solution consists in providing an intermediate element of the clasp type placed between the two bracelet strands which always remains secured to the ends of these two strands. Such a clasp occupies two positions: a closed position, provided for the wearing of the watch, in which the bracelet and the clasp extend over the periphery of the wrist while having a total length allowing the wristwatch to be held, and an open position which makes it possible to increase the length of the bracelet and of the clasp, by parting the two ends of the two strands of the bracelet without detaching them from the clasp in order to allow the hand to pass through and the removal of the watch. In this open configuration of the clasp, the two strands of the bracelet are not separated, which minimizes the risk of the watch falling.

A clasp of the prior art, called a "double opening deployment clasp", comprises two leaves mounted so as to be rotatably movable respective to the two ends of a central blade, and able to be folded over this central blade. These three folding leaves make it possible to substantially increase the length of the bracelet in the open position of the clasp.

Document CH649205 illustrates an exemplary embodiment of a double opening deployment clasp. This solution has a first drawback of depending on the materials used because it depends partly on the elasticity of the leaves of the clasp. Such a clasp therefore has characteristics that vary depending on the materials used, for example gold or steel, which is not ideal. A second drawback of this solution arises from the fact that it necessitates two distinct operations for closing it and opening it, because the two movable leaves are operated independently of one another. Finally, the coupling of these two movable leaves is not very efficient, not very secure and causes rapid wear of the notching elements used.

Document CH699044 describes another solution in which the coupling mechanism is more efficient. However, this solution is not very user-friendly because it still necessitates too great a number of operations to actuate it.

Document EP1925227 proposes the addition of an actuating button connected to a mechanism for locking/unlocking the leaves. Even though this solution allows the clasp to be opened by the single operation of actuating the button, it is not acceptable because this button and the associated mechanism have too great and negative an impact on the esthetic appearance of the clasp.

Document CH689931 describes another double opening deployment clasp solution in which a first blade is used to hold a second in the closed position.

The actuation of two movable leaves must therefore be carried out in a well defined order in the closed position, which is not acceptable.

There is therefore a need for a solution for wearing a wristwatch which makes it possible to retain the advantages of the prior art while reducing its drawbacks.

For this reason the invention seeks to achieve all or some of the following objects.

A first object of the invention consists in proposing a solution for closing a bracelet with the aid of a clasp that is very user-friendly to operate.

A second object of the invention consists in proposing a solution for closing a watch bracelet with the aid of a clasp of which the coupling in the closed position is secure.

A third object of the invention consists in proposing a solution for closing a watch bracelet with the aid of a clasp of which the operation does not cause too rapid wear and remains independent of the materials used.

BRIEF DESCRIPTION OF THE INVENTION

Accordingly, the invention proposes a bracelet clasp, characterized in that the two movable leaves comprise at least one element for interaction between them which acts on at least one of them when one of them is actuated, in the closing and/or opening phase of the clasp.

The invention is precisely defined by the claims.

BRIEF DESCRIPTION OF THE FIGURES

These objects, features and advantages of the present invention will be explained in detail in the following description of particular embodiments made in a nonlimiting manner with respect to the attached figures amongst which.

DETAILED DESCRIPTION OF PARTICULAR EMBODIMENTS

A particularly embodiment of a double opening deployment clasp will now be described in a detailed and nonlimiting manner.

Figure 1:
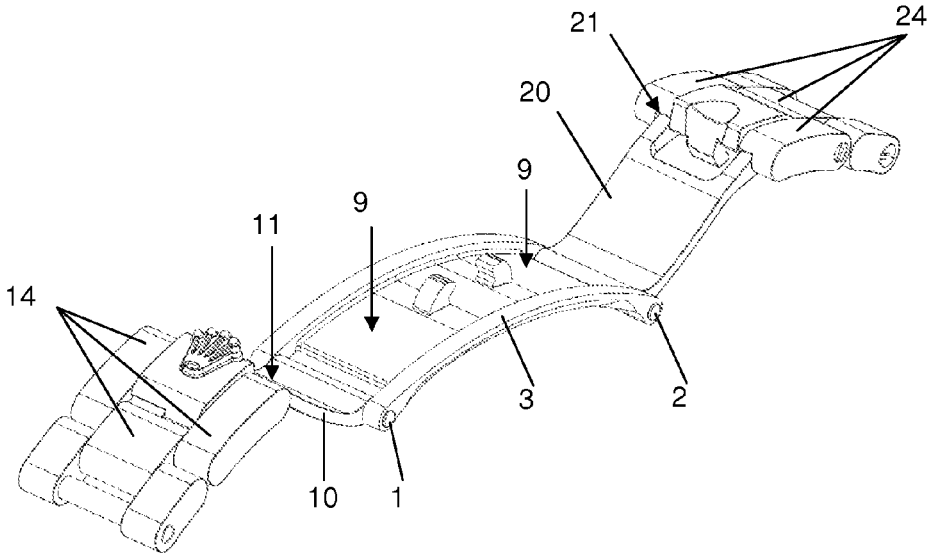
FIG. 1 represents a view in perspective of a clasp in the open configuration according to one embodiment of the present invention.
Figure 2:
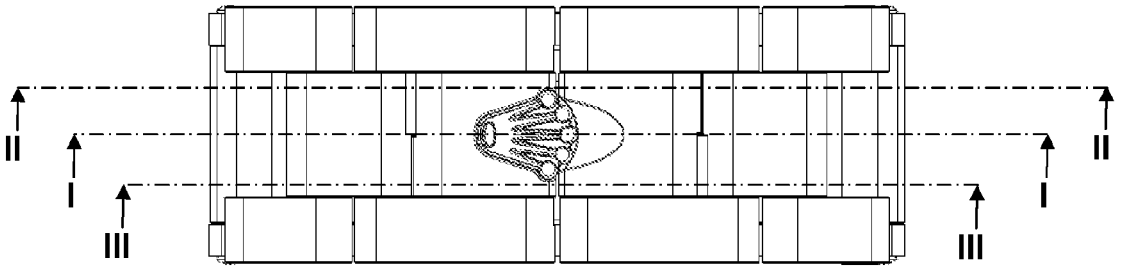
FIG. 2 represents a view from above of the clasp in the closed configuration according to the embodiment of the present invention.

As shown in FIG. 1, the double opening deployment clasp comprises a central blade 3 at the ends of which are respectively mounted movably by pivoting, a first fold-over movable blade 10 and a second fold-over movable blade 20, about respectively a first spindle 1 and a second spindle 2. Grooves 9 are made on the central blade 3 in order to make it easier to house the movable leaves 10, 20 in the folded position and minimize the overall thickness of the clasp. Each of the two movable leaves 10, 20 comprises, at its free end 11, 21, opposite to its spindle 1, 2 for connection with the central blade 3, a means for connection with a bracelet strand. Notably, it comprises at least one first link 14, 24 mounted so as to be movable in rotation on this free end. It also comprises a locking and/or unlocking device provided for the action of locking and unlocking it on the central blade in order to obtain the closed configuration, shown in a view from above in FIG. 2, and/or the open configuration, shown in FIG. 1, of the clasp, as will be illustrated below.

Figure 3:
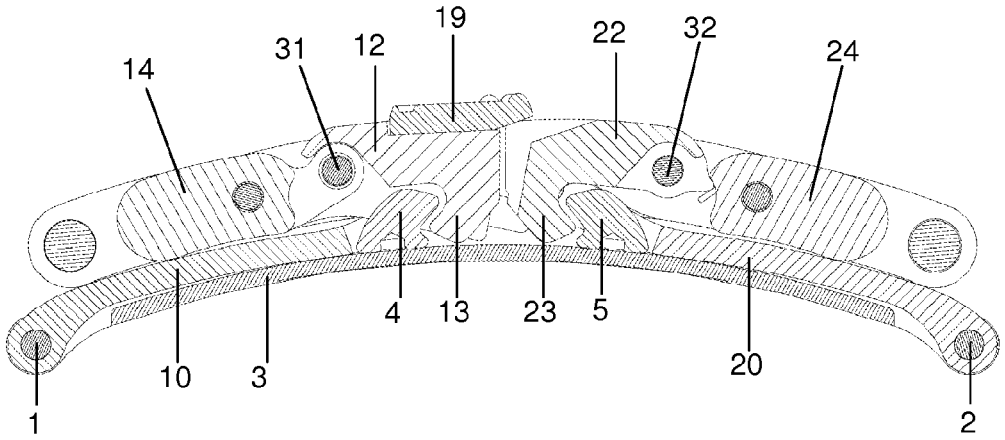
FIG. 3 represents a view in section along a mid-plane I-I of the clasp in the closed configuration according to the embodiment of the present invention.

The invention does not relate specifically to the device for locking and/or unlocking the movable leaves 10, 20. It is advantageously compatible with a locking device that is user-friendly and secure which is particularly effective. Therefore, it uses, for example, the solution that can be seen in FIG. 3 which is described in document EP1654950, which is incorporated herein by reference. For this, each of the two movable leaves 10, 20 comprises toward its free end a lever 12, 22 secured to a coupling element 13, 23 in the form of a hook, capable of interacting with a coupling post 4, 5 arranged in a predefined zone on the surface of the central blade 3, for example a central zone on the surface of the central blade 3, secured to the latter. This lever 12, 22 is more precisely mounted so as to rotate about a spindle 31, 32 on the link 14, 24 connected to the free end 11, 22 of the movable blade 10, 20.

Figure 4:
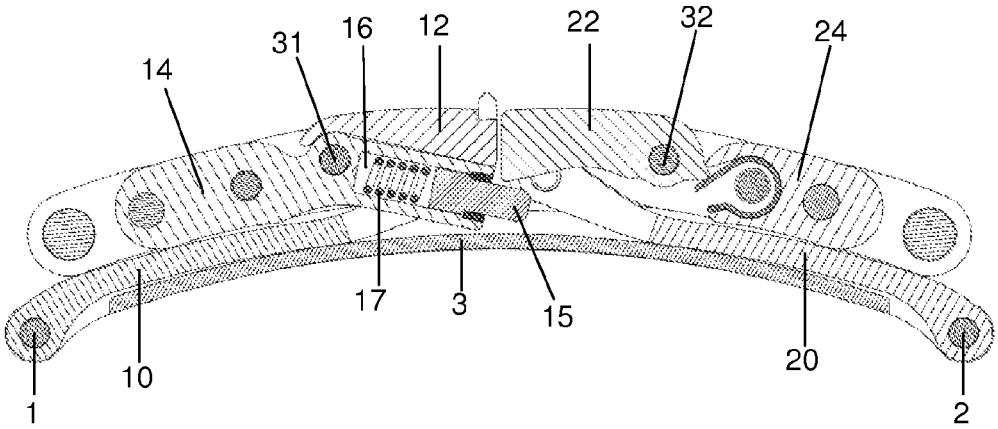
FIG. 4 represents a view in section along a first off-center plane II-II of the clasp in the closed configuration according to the embodiment of the present invention.
Figure 5:
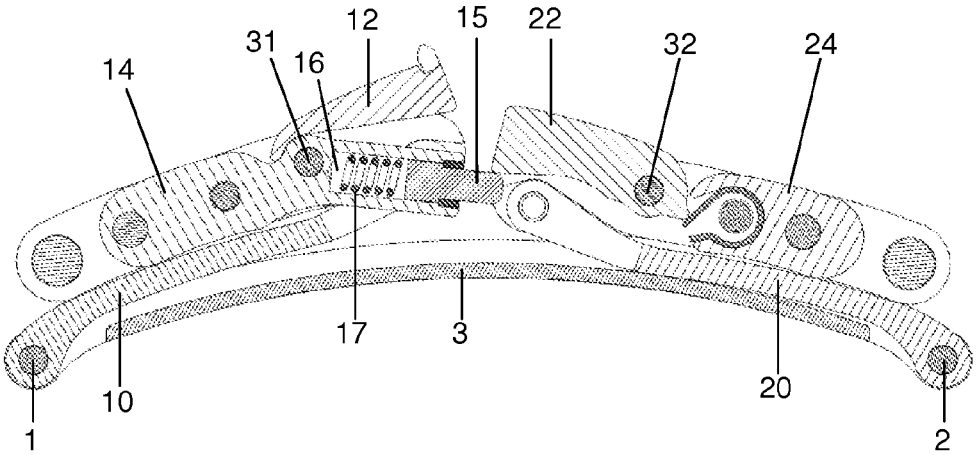
FIG. 5 represents a view in section along the first off-center plane II-II of the clasp in the opening phase according to the embodiment of the present invention.

According to this embodiment, the first movable blade 10 is secured to a finger 15 in order to interact with the second movable blade 20 that can be seen in FIG. 4 which represents a section level with this finger of the clasp in the closed position. As is evident, the finger 15 passes beyond the end of the lever 12 and is housed under the lever 22 of the second movable blade 20. This solution allows a wearer of the clasp to unlock and simultaneously release the two movable leaves 10, 20 by actuating only the lever 12 of the first blade. Specifically, as emerges from FIG. 5, which illustrates the beginning of a phase for opening the clasp, the unlocking of the lever 12 and the deployment of the first movable blade 10 causes, in its movement, the deployment of the second movable blade 20, under the effect of its contact with the finger 15 which comes into contact with the surface of the lever 22 associated with this second movable blade 20.

Figure 6:
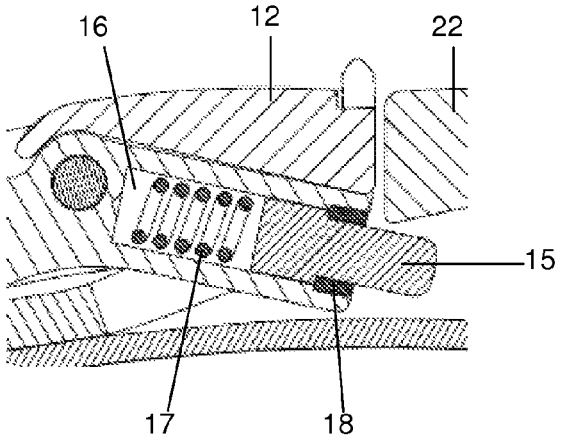
FIG. 6 represents an enlarged view in section along the first off-center plane II-II level with an interaction finger of the clasp in closed configuration according to the embodiment of the present invention.

As is particularly visible in FIG. 6, the finger 15 is placed in a recess 16 of the link 14. It interacts with an elastic element 17, such as a coil spring in this embodiment, which holds it in a position which protrudes from the link, as has been seen above for example with reference to FIG. 4. A ring 18 placed toward the outer end of the recess 16 forms an abutment for the finger 15. The elastic element 17 preferably acts in compression and preferably always acts in tension so as to permanently exert a force on the finger 15 which tends to press it against this ring 18. As a variant, the elastic element may be at rest or close to its rest position when the finger 15 is in contact with the ring 18. The recess 16 is of a dimension to allow the finger 15 to retract while moving within it against the elastic element 17.

Figure 7:
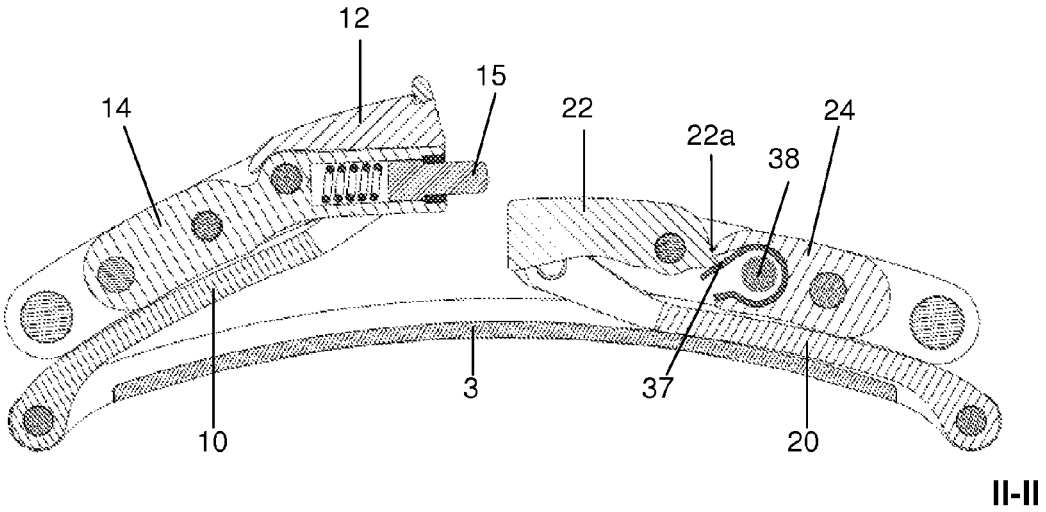
FIGS. 7 to 9 represent various views in section along the first off-center plane II-II of the clasp during a closing phase according to the embodiment of the present invention.
Figure 8:
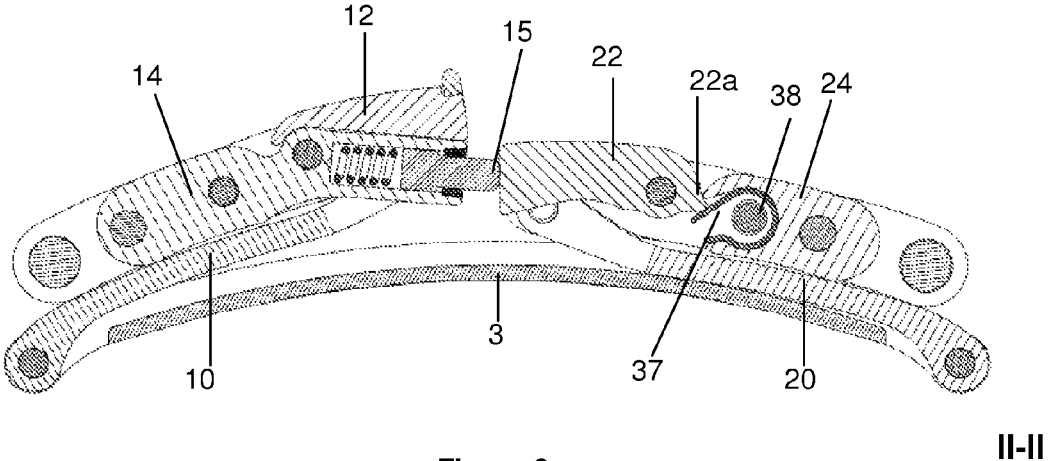
Figure 9:
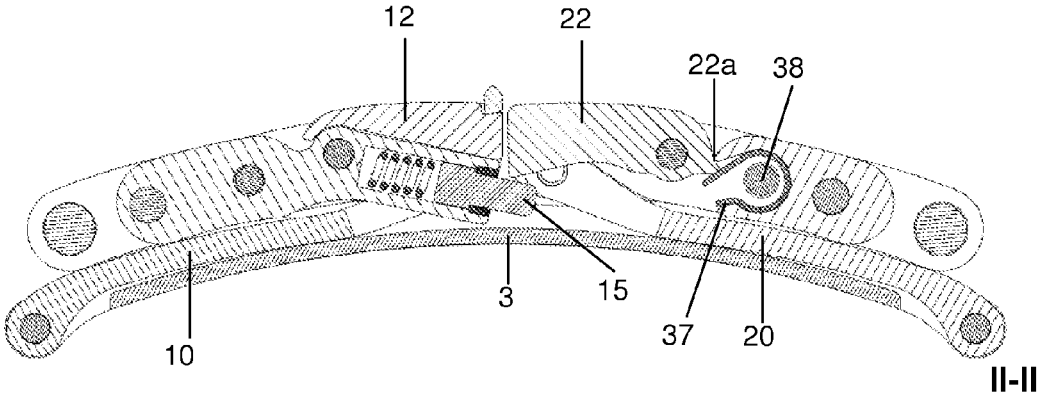

A complementary effect of this solution is that it allows the closure of the two movable leaves 10, 20 in any order. Specifically, the first movable blade 10 which comprises the finger 15 can naturally be closed first. On the other hand, if the second movable blade 20 is closed first, as is illustrated in FIG. 7, the finger 15 protruding from the lever 12 that is linked to the first movable blade 10 comes into contact with the end of the second movable blade 20 at the time of its closure, more precisely of the end of its lever 22 in this embodiment. During this contact, the finger 15 retracts totally fully or partly inside the recess 16, as illustrated in FIG. 8, until the first movable blade 10 reaches its closed position, illustrated by FIG. 9, in which the finger returns to its nonretracted position in a space provided beneath the lever 22 of the second movable blade 20.

As a comment, the ends of the finger 15, of the levers 12, 22 and optional gripping member of the levers have a shape such that their interaction in all the opening and closing phases of the movable leaves causes no blockage of their respective movements, but exerts, where appropriate, a force oriented such that it induces the retraction of the finger.

Figure 10:
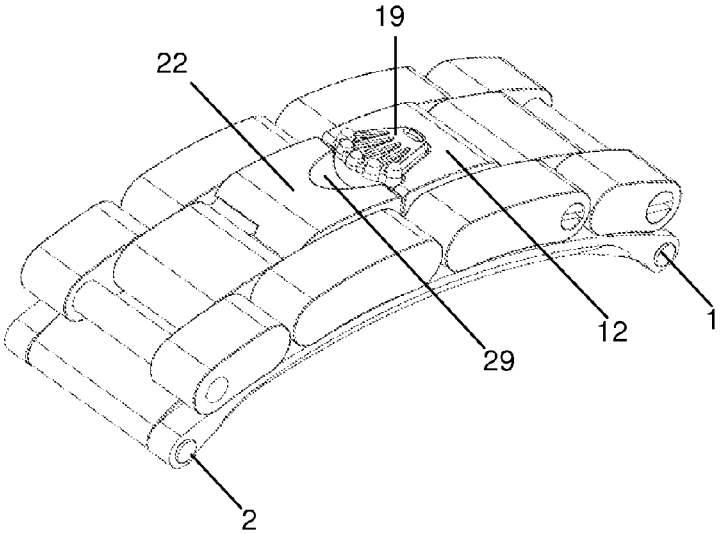
FIG. 10 represents a view in perspective from above of the clasp in the closed configuration according to the embodiment of the present invention.

The first movable blade 10, more precisely its lever 12, comprises a gripping member 19 for making it easier to operate, notably to open it, since it is designed to be opened first, before automatically causing the opening of the second movable blade 20. Advantageously, this gripping member 19 is placed in the top portion of the lever 12, partially embedded in the top surface of the lever 12 in order to minimize the total thickness of the clasp and to form part of the continuity of the bracelet, as appears in FIGS. 2 and 10. A cutout 29 is arranged on the top face of the lever 22 of the second movable blade 20 opposite the gripping member 19 in order to make it easier to take hold of. Thus, the actuation of this gripping member causes the unlocking of the first movable blade 10 and then its opening, which induces the actuation of the lever 22 of the second movable blade 20 and its unlocking.

Figure 11:
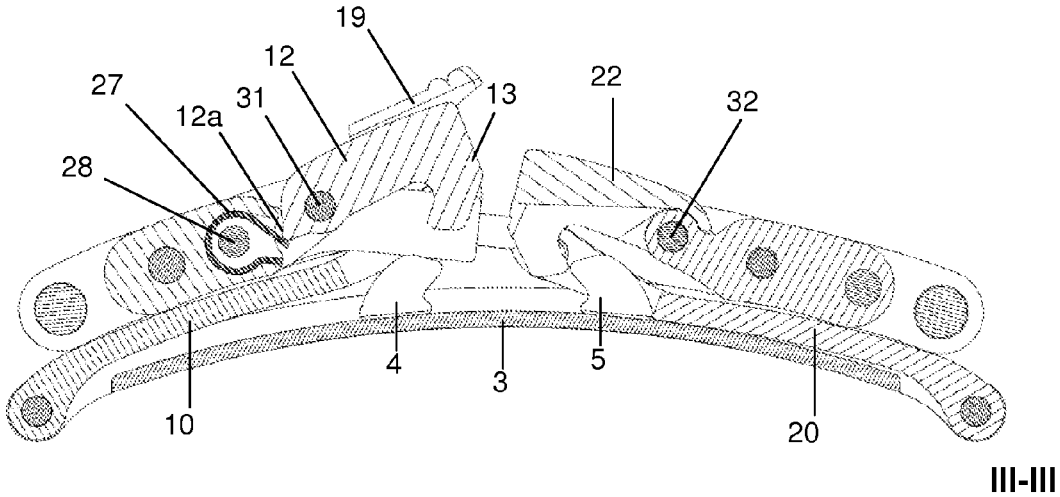
FIG. 11 represents a view in section along a second off-center plane III-III of the clasp in the opening or closing phase according to the embodiment of the present invention.

In this solution, each movable blade 10, 20 is therefore furnished with its own locking/unlocking device which allows it to be held in position folded over onto the central blade 3. As has been seen and illustrated above, this locking/unlocking device may be of the type described in document EP1654950. For this, each movable blade 10, 20 therefore comprises toward its free end a lever 12, 22 secured to a coupling member, as has been seen. This lever is associated with an elastic member 27, 37 which exerts a torque on it attending to rotate it in the direction allowing the locking of its coupling member. This elastic element 27 of the first movable blade 10 can be seen in FIG. 11 of a section along a second offset plane III-III of the clasp in slightly open configuration. The elastic element 27 may consist of a spring arranged around a spindle 28, of which one end rests on a portion secured to the movable blade 10, the link 14 notably, distinct from the lever 12, and of which a second end rests on the lever 12. The latter also comprises an abutment 12*a* which limits this rotational movement to an inclination corresponding to the locked position.

The elastic element 37 of the second movable blade 20 can be seen in the sections of FIGS. 4, 5, 7 and 8 produced along an offset plane II-II of the clasp. The elastic element 37 may consist of a spring arranged about a spindle 38, of which one end rests on a portion secured to the movable blade 20, the link 24 notably, distinct from the lever 22, and of which a second end rests on the lever 22. The latter also comprises an abutment 22*a* which limits this rotational movement to an inclination corresponding to the locked position.

Finally, as has been explained, the clasp according to the embodiment of the invention has the following advantages:

- it allows the unlocking and/or the at least partial deployment of the two movable leaves by actuating only one of the two movable leaves, or its locking/unlocking device, which automatically causes the unlocking and/or the opening of the second movable blade;

the two movable leaves may be closed in any order. If the blade (10) is closed before the blade (20), the finger (15) is not involved in the phase of closing these two leaves. If the blade (10) is closed after the blade (20), the finger (15) is retracted;

the locking of the two movable leaves may be reliable and secure because the solution is compatible with the implementation of very efficient locking/unlocking devices that are independent of the materials used.

Naturally, a large number of components of this double opening deployment clasp could take a different form.

For example, the interaction finger 15 could take any other form, could be any interaction element. There could be two or more than two fingers, to stabilize the interaction. This interaction element could have only one action limited on the second movable blade, like only its unlocking or driving, on a fairly long travel. In a simplified variant, it could be nonretractable. According to another variant, it could be retracted by a movement other than a linear travel, such as by a rotation. Naturally, it can be placed on one or other of the two movable leaves, or even be partially distributed over the two movable leaves. As a further variant, the two movable leaves may be fitted with an interaction element, in order to allow, for example, the opening of the clasp by the actuation of one or the other of the two movable leaves.

Moreover, the movable leaves could take other forms, be symmetrical or not, comprise any type of locking and/or unlocking device. In general, the architecture of the clasp itself may be different.

The invention has been illustrated based on a bracelet associated with a wristwatch which is moreover also involved as such in this invention. As a variant, the clasp may be associated with any other bracelet, for any object to be attached to a wrist or any other portion. This object may be a diving accessory such as a depth gage for example, or else a jewelry component.

The invention claimed is:

1. A bracelet clasp comprising first and second movable leaves pivoted about a central blade, wherein the bracelet clasp can occupy a first closed position suitable for holding a bracelet around a wrist of a wearer and a second open position suitable for removing the bracelet from a hand of the wearer, wherein the second movable leaf comprises a locking device locking the second movable leaf to the central blade in a closed configuration of the clasp, wherein the first and second movable leaves comprise at least one interaction element between them, wherein the interaction element automatically performs at least one of (i) locking, (ii) unlocking, and (iii) setting in motion of the second movable leaf when the first movable leaf is actuated, wherein the first movable leaf comprises a first locking device locking the first movable leaf to the central blade in the closed configuration of the clasp, and the locking device of the second movable leaf is a second locking device locking the second movable leaf to the central blade in the closed configuration of the clasp, wherein the first movable leaf comprises the interaction element, and wherein the interaction element bears on a downward surface of the second movable leaf during the unlocking and the opening of the first movable leaf so as to automatically unlock the second movable leaf.

2. The bracelet clasp as claimed in claim 1, wherein the interaction element is at least one finger on the first movable leaf, wherein the at least one finger comes into contact on the second movable leaf when the first movable leaf is actuated, so as to cause the at least one of (i) locking, (ii) unlocking, and (iii) setting in motion of the second movable leaf.

3. The bracelet clasp as claimed in claim 2, wherein the at least one finger of the first movable leaf is placed relative to a surface of the second movable leaf in a closed configuration of the clasp in order to cause at least one of (i) the unlocking and (ii) an opening of the second movable leaf when the first movable leaf is opened.

4. The bracelet clasp as claimed in claim 3, wherein the at least one interaction element can be retracted elastically so as to be able to retract during the closure of the first and second movable leaves in order to allow the movable leaves to close in any order, and to not retract during the opening of the movable leaves in order to induce the simultaneous opening of the movable leaves in a single manipulation.

5. The bracelet clasp as claimed in claim 4, wherein the at least one finger is mounted so as to be able to move elastically, wherein the finger comes into contact on the second movable leaf when the first movable leaf is opened, so as to cause the opening of the second movable leaf, and wherein the finger retracts during the closure of the first movable leaf after that of the second movable leaf so as not to prevent the closure of the first movable leaf.

6. The bracelet clasp as claimed in claim 2, wherein the first movable leaf comprises a link mounted so as to be able to move at a free end of the first movable leaf, wherein a first end of the link comprises an element for linking with a bracelet strand, and wherein a second end of the link comprises a recess within which the at least one finger is arranged on which an elastic element, such as a spring, acts so that the at least one finger protrudes from the link under an effect of the spring.

7. The bracelet clasp as claimed in claim 2, wherein the at least one interaction element can be retracted elastically so as to be able to retract during the closure of the first and second movable leaves in order to allow the movable leaves to close in any order, and to not retract during the opening of the movable leaves in order to induce the simultaneous opening of the movable leaves in a single manipulation.

8. The bracelet clasp as claimed in claim 7, wherein the at least one finger is mounted so as to be able to move elastically, wherein the finger comes into contact on the second movable leaf when the first movable leaf is opened, so as to cause the opening of the second movable leaf, and wherein the finger retracts during the closure of the first movable leaf after that of the second movable leaf so as not to prevent its closure.

9. The bracelet clasp as claimed in claim 1, wherein the at least one interaction element can be retracted elastically so as to be able to retract during a closure of the first and second movable leaves in order to allow the movable leaves to close in any order, and to not retract during the opening of the movable leaves in order to induce a simultaneous opening of the movable leaves in a single manipulation.

10. The bracelet clasp as claimed in claim 9, wherein the interaction element is a finger mounted on the first movable leaf so as to be able to move elastically, wherein the finger comes into contact on the second movable leaf when the first movable leaf is opened, so as to cause the opening of the second movable leaf, and wherein the finger retracts during the closure of the first movable leaf after that of the second movable leaf, so as not to prevent the closure of the first movable leaf.

11. The bracelet clasp as claimed in claim 1, wherein at least one free end of at least one of the first and second movable leaves comprises a lever articulated about a spindle, the lever comprising a coupling element and the central blade comprising a coupling post in order to interact with the coupling element when the at least one of the first and second movable leaves is locked, the lever comprising an elastic element exerting a torque tending to hold the coupling element in a locked position.

12. The bracelet clasp as claimed in claim 11, wherein an engagement and a disengagement of the coupling element of the at least one of the first and second movable leaves with the coupling post of the central blade comprise a pivoting of the lever against the elastic element of the lever.

13. The bracelet clasp as claimed in claim 11, wherein the first lever of the first movable leaf comprises a gripping member for an operation of the first lever in a direction of unlocking the first movable leaf.

14. The bracelet clasp as claimed in claim 13, wherein at least one of (i) the gripping member is at least partially placed within the top surfaces of the first and second movable leaves in order to minimize a total thickness of the clasp and (ii) one end of the gripping member comes into a groove of the second movable leaf in order to make the gripping member easier to grip.

15. The bracelet clasp as claimed in claim 1, wherein the first locking device comprises a first lever articulated at a first free end of the first movable leaf for locking the first movable leaf to the central blade, and the second locking device comprises a second lever articulated at a second free end of the second movable leaf for locking the second movable leaf to the central blade.

16. The bracelet clasp as claimed in claim 15, wherein the first movable leaf comprises the interaction element, which is a finger and which bears on a bottom surface of the second lever of the second movable leaf during the unlocking and the opening of the first movable leaf so as to automatically unlock the second movable leaf.

17. The bracelet clasp as claimed in claim 15, wherein the first movable leaf comprises the interaction element, which is a finger and which bears on a surface during the closure of the first movable leaf after that of the second movable leaf, which generates a bearing force on the interaction element and an elastic retraction of the interaction element, and wherein when the first movable leaf is in the locked position, the interaction element reemerges under a bottom surface of the second lever of the second movable leaf.

18. A bracelet comprising two strands, wherein ends of the two strands are connected to a clasp as claimed in claim 1.

19. A wristwatch, which comprises a bracelet and a clasp as claimed in claim 1 connected to the bracelet.

20. The bracelet clasp as claimed in claim 1, wherein the interaction element is separate from the second locking device.

21. A bracelet clasp comprising first and second movable leaves pivoted about a central blade, wherein the bracelet clasp can occupy a first closed position suitable for holding a bracelet around a wrist of a wearer and a second open position suitable for removing the bracelet from a hand of the wearer, wherein the first and second movable leaves comprise at least one interaction element between them, wherein the interaction element automatically performs at least one of (i) setting in motion of the second movable leaf when the first movable leaf is set in motion, (ii) setting in motion of the second movable leaf when the first movable leaf is unlocked, and (iii) unlocking of the second movable leaf when the first movable leaf is set in motion, wherein the first movable leaf comprises a first locking device locking the first movable leaf to the central blade in the closed configuration of the clasp, and the second movable leaf comprises a second locking device locking the second movable leaf to the central blade in the closed configuration of the clasp, wherein the first movable leaf comprises the interaction element, and wherein the interaction element bears on a downward surface of the second movable leaf during the unlocking and the opening of the first movable leaf so as to automatically unlock the second movable leaf.

* * * * *